US010247509B1

(12) United States Patent
Sumners

(10) Patent No.: US 10,247,509 B1
(45) Date of Patent: Apr. 2, 2019

(54) FIRE STARTING FLARES LAUNCHER

(71) Applicant: Bill Sumners, Inyokern, CA (US)

(72) Inventor: Bill Sumners, Inyokern, CA (US)

( * ) Notice: Subject to any disclaimer, the term of this patent is extended or adjusted under 35 U.S.C. 154(b) by 0 days.

(21) Appl. No.: 15/936,320

(22) Filed: Mar. 26, 2018

Related U.S. Application Data

(60) Provisional application No. 62/477,580, filed on Mar. 28, 2017.

(51) Int. Cl.

| | |
|---|---|
| ***F41B 11/723*** | (2013.01) |
| ***F41B 11/80*** | (2013.01) |
| ***F41B 11/62*** | (2013.01) |
| ***F41B 11/55*** | (2013.01) |

(52) U.S. Cl.
CPC ..... *F41B 11/723* (2013.01); *F41B 11/55* (2013.01); *F41B 11/62* (2013.01); *F41B 11/80* (2013.01)

(58) Field of Classification Search
CPC .. F41C 3/005; F41C 3/02; F41C 27/06; A63B 69/409; F41J 9/18; F41B 11/55; F41B 11/62; F41B 11/80; F41B 11/723; F41B 11/56; F41B 11/721; F41B 11/81; F41B 11/83; F41B 11/85; F41B 11/87; F41B 11/89
USPC ..... 124/56; 42/1.08, 1.15; 89/1.34
See application file for complete search history.

(56) References Cited

U.S. PATENT DOCUMENTS

| | | | | |
|---|---|---|---|---|
| 2,355,045 A * | 8/1944 | Audet | F41A 17/38 42/50 |
| 3,243,909 A * | 4/1966 | Kotikov | F41C 27/06 102/483 |
| 3,318,033 A * | 5/1967 | Barr | F41C 27/06 102/483 |
| 3,826,031 A * | 7/1974 | Gabriels | F41C 27/06 102/483 |
| 6,128,845 A * | 10/2000 | Jacobson | A62C 99/0054 42/1.15 |
| 10,054,390 B1 * | 8/2018 | Hane | F41A 5/02 |
| 2003/0069091 A1 * | 4/2003 | Wengert | A63B 69/36 473/409 |

(Continued)

*Primary Examiner* — John Cooper
(74) *Attorney, Agent, or Firm* — Sandy Lipkin

(57) ABSTRACT

A large format launcher that is a modified rifle wherein the lower receiver is combined with an upper receiver into a unified receiver and modified to fit large-format flares. It is a single-shot, non-automatic reloading device, slam fire flare launcher device. The gas tube from an unmodified rifle is removed from the upper receiver disabling the bolt carrier group from automatic operation. The gas port is plugged and welded closed which prevents an operational gas tube from being installed on the launcher. The outer tube is pinned with a non-removable hardened pin. A single blank cartridge is fed into the launcher via a ten-round modified magazine. Manual cocking of the charging handle is required between firings. The ported gas barrel/plug, manufactured specifically for this launcher, employs an external hardened end with offset hole with welded plug enabling acceptance of a blank round only. The plug prevents any projectile from passing through the ported gas barrel and prevents the firing of live ammunition. With only gas from the blank passing through the barrels, the flare is launched and propelled approximately 300 feet and lights the flare with appropriate delay to function.

4 Claims, 3 Drawing Sheets

(56) References Cited

U.S. PATENT DOCUMENTS

| | | | | |
|---|---|---|---|---|
| 2013/0097909 | A1* | 4/2013 | Watchorn | F41A 9/65<br>42/50 |
| 2015/0198407 | A1* | 7/2015 | Giannelli | F41B 11/62<br>124/76 |
| 2018/0216910 | A1* | 8/2018 | Malarkey | F41C 3/005 |

* cited by examiner

FIRE STARTING FLARES LAUNCHER

REFERENCE TO PRIOR APPLICATION

This application claims priority of the provisional patent application 62/477,580, filed Mar. 27, 2017 by Bill Sumners.

BACKGROUND OF THE INVENTION

Field of the Invention

The field of this invention relates generally to the field of incendiary devices, and more particularly toward a flare launching device to aid in initiating controlled burns to prevent uncontrolled wildfires.

Description of the Prior Art

This invention relates to incendiary devices to initiate back fires, control burns, firebreaks and more particularly toward the launching of incendiary devices that permit brush fires to be started remotely from the person controlling the device. Forest and brush fires are major problems for both the communities and firefighters that have to deal with them on a regular basis, such as the western part of the United States.

Forest fires can be either controlled or prevented by intentionally igniting fires as a control mechanism. A fire can be set to burn off accumulated fuel during a season where there is little chance of creating an uncontrolled fire. This is known as a controlled burn. The following description is for the control of wildland fires, although similar conditions exist for the controlled burn. For most of these fires, the goal is to gain control as quickly as possible. One technique regularly employed to establish control is the use of a backfire. A backfire burns areas in the fire's path in order to deprive the fire of fuel, thereby creating buffer zones that impede the fires. A large variety of prior art devices have been used to start backfires.

A partial list of such devices includes matches, electric lighters, hand-thrown devices, such as fuses, drip torches, plastic bags of gelled fuel, canister devices, pneumatic torches, propane torches, power flame throwers, flare pens, signal pistols, and various launching devices. Launching devices range from compressed air to slingshots.

It is the object of the instant invention to provide an improved method and device for accomplishing the same goals as the prior art.

It is a further object of the invention to provide a unified receiver for the launching of devices, such as flares, tear gas, grappling hooks or any other object that needs to be remotely launched.

SUMMARY OF THE INVENTION

The basic embodiment of the present invention teaches a single-shot, non-automatic reloading launcher device comprising: a single unified receiver; a welded magazine block inside of said receiver, said magazine block being configured to receive a specialized magazine, said specialized magazine allowing only the receipt of a single blank round; an outer tube of sufficient size to house an item to be launched; a gas plug positioned between said outer tube and said receiver where said single blank round is received; a firing pin positioned proximate said single blank round; a slam fire bolt actuator positioned proximate said firing pin; a buffer tube proximate said slam fire bolt actuator that is activated by a drop bolt lever wherein said buffer tube is surrounded by an activating buffer coil that provides the pressure to strike said firing pin to ignite the launcher.

The above embodiment can be further modified by defining that said gas plug further comprises: a mounting base; an elongated member; an external hardened end on said elongated member opposite said mounting base; an orifice positioned along said elongated member to regulate gas flow; one or more channels along the length of said elongated member to further regular gas flow.

An alternate embodiment of the instant invention teaches a method of manufacturing a launching device from an existing firearm comprising the steps of: acquiring an automatic rifle said rifle comprising an upper receiver, a lower receiver, an inner gas tube, an outer tube, a bolt carrier group, a barrel and a trigger; removing said gas tube from said rifle from said upper receiver thereby disabling said bolt carrier group from automatic operation; plugging the gas port left from the removal of said gas tube; installing a gas plug; replacing said barrel with an outer tube of sufficient size to house a large flare or other device to be launched; pinning said outer tube to said gas plug with a non-removable hardened pin; welding a magazine block to said lower receiver; inserting a magazine modified to fit into said welded magazine block; providing a single blank cartridge which is fed into said magazine; welding shut said upper receiver and said lower receiver into a unified receiver; removing said trigger mechanism; and replacing said trigger mechanism with a drop bolt lever.

The above embodiment can be further modified by defining that said gas plug further comprises: a mounting base; an elongated member; an external hardened end on said elongated member opposite said mounting base; an orifice positioned along said elongated member to regulate gas flow; one or more channels along the length of said elongated member to further regular gas flow.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
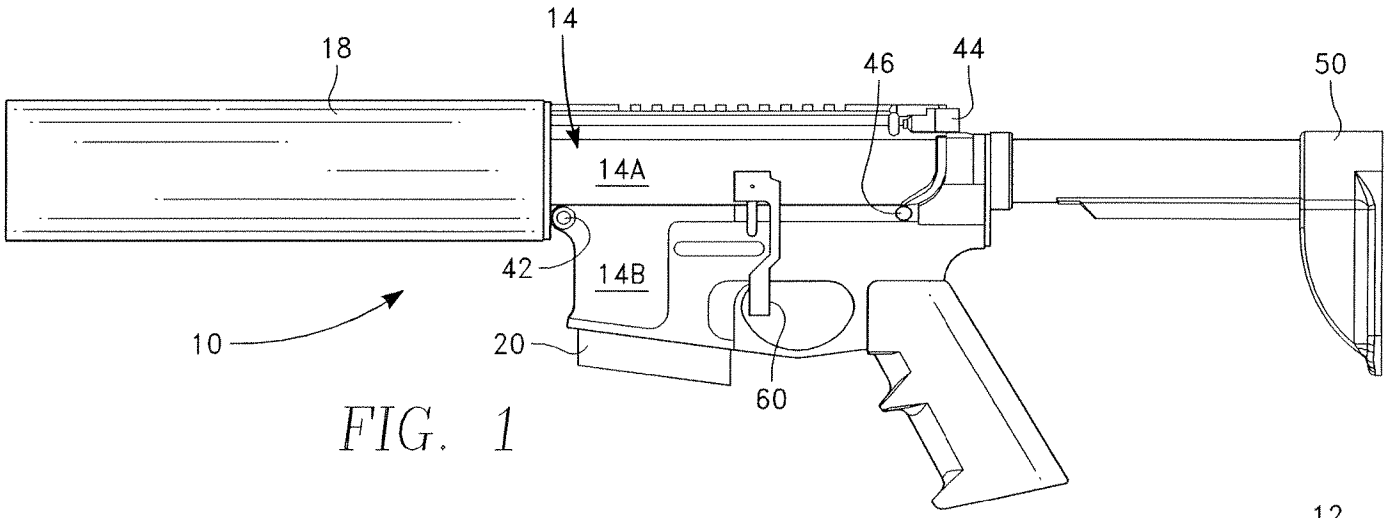
FIG. 1 is a side view of the flare launcher of the instant invention.
Figure 2:
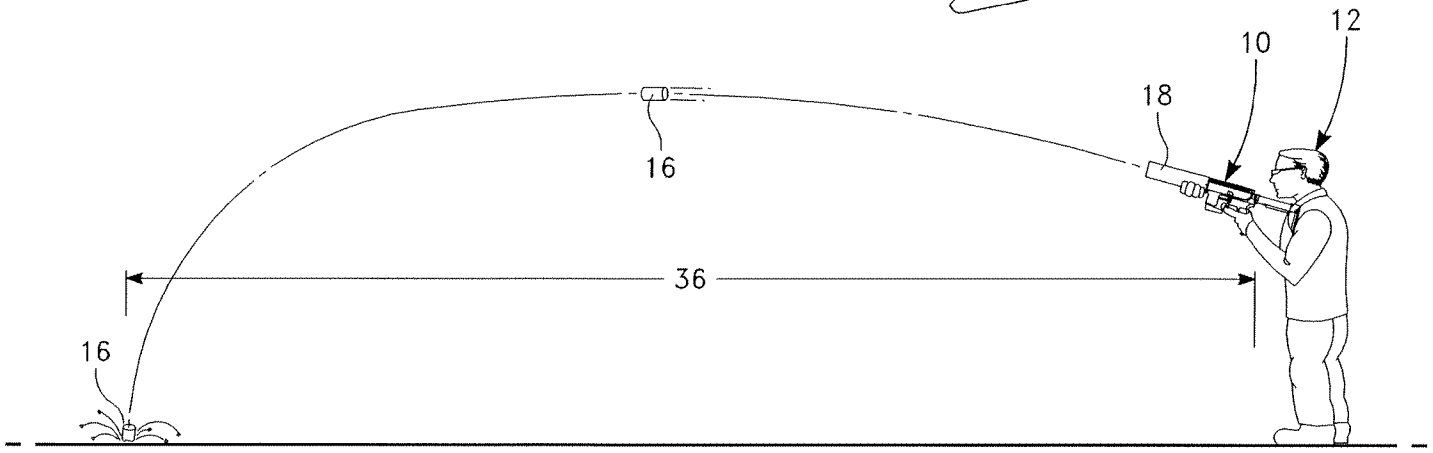
FIG. 2 is a side view illustrating the flare launcher of the instant invention in use.

Turning to the drawings, the preferred embodiment is illustrated and described by reference characters that denote similar elements throughout the several views of the instant invention.

The instant invention provides a single shot, non-automatic reloading rifle style, slam fire flare launching device 10. The launcher 10 is suitable for multiple launches of flares 16 or other item with a blank magazine 20. It uses a slam fire mechanism 22 rather than the trigger used on the non-modified rifle. This invention is categorically NOT a firearm and has been modified not only to launch flares to start backfires, but also to prevent its use as a firearm. The device 10 is manufactured through modifications made to an AR-15 rifle that disable the device as a firearm and provide a means for launching flares or any other item to a distance of 300 feet. The device has been approved by the Bureau of Alcohol, Tobacco and Firearms as a non-firearm.

In the instant device, the upper 14A and lower receivers 14B of a non-modified rifle are combined into a single, unitary receiver 14 through the inclusion of a welded pivot pin 42 located at the front of the receiver 14 where the upper 14A and lower receivers 14B would separate on the non-modified device. Because of this welding shut of the upper 14A and lower 14B receivers into a single receiver 14, the device 10 of the instant invention is prevented from being separated and used as a firearm.

The launcher 10 is designed in its preferred embodiment to launch large format flares 16 using a 223/5.56 caliber blank cartridge 28. As modified, the launcher 10 is a single-shot, non-automatic reloading device in that each time an item, such as a flare 16 is to be launched, the device 10 has to be recharged with the charging handle 44 and is therefore non-automatic. The operator 12 must pull the charging handle 44 after each shot to reload the launcher 10 with new blank cartridge 28. There is no gas tube on the device 10 to operate the bolt carrier group 30 as is found in the unmodified device. As a result, it is a single-shot only. The single shot blank 28 feed is accomplished via a mutable round magazine 20 that is modified with a notch 58 that allows only blank cartridges 28 to fit therethrough. The length of a live round 64 prohibits it from fitting into the modified magazine 20. The magazine 20 then fits into the device 10 where it is received with a welded magazine block 56 that is positioned to limit the size of the magazine 20 to be fit therein to be unable to hold a live round 64.

Additionally, while the upper 14A and lower receivers 14B cannot be detached from each other due the welded pivot pin 42, the rear pivot pin 46 can be removed to allow for servicing of the launcher 10 as needed. To actuate the launching of a flare 16, the trigger mechanism of the unmodified device has been replaced with a drop bolt lever 60. Adjacent the butt stock 50 of the device is a buffer tube 52 with a buffer spring 54 that is longer than the spring found in the unmodified device providing increased pressure on the spring by 30% to assist in the launching of larger items, such as flares. The bolt drop lever 60 actuates the slam fire mechanism of the device 10 the flare 16 is launched to a distance 36 of approximate 300 feet.

Figure 3:
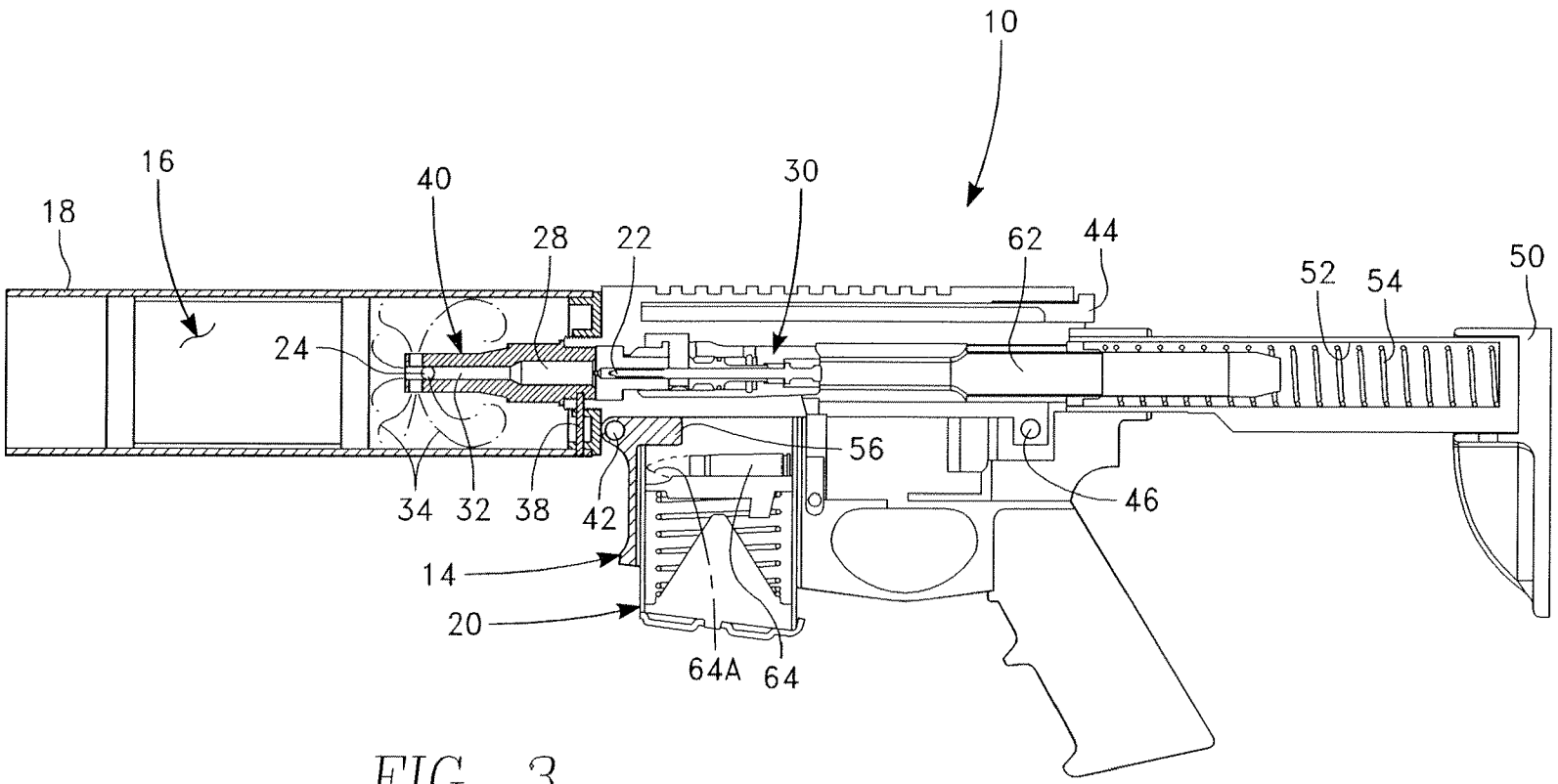
FIG. 3 is an internal side view of the flare launcher of the instant invention as it is deployed.
Figure 4:
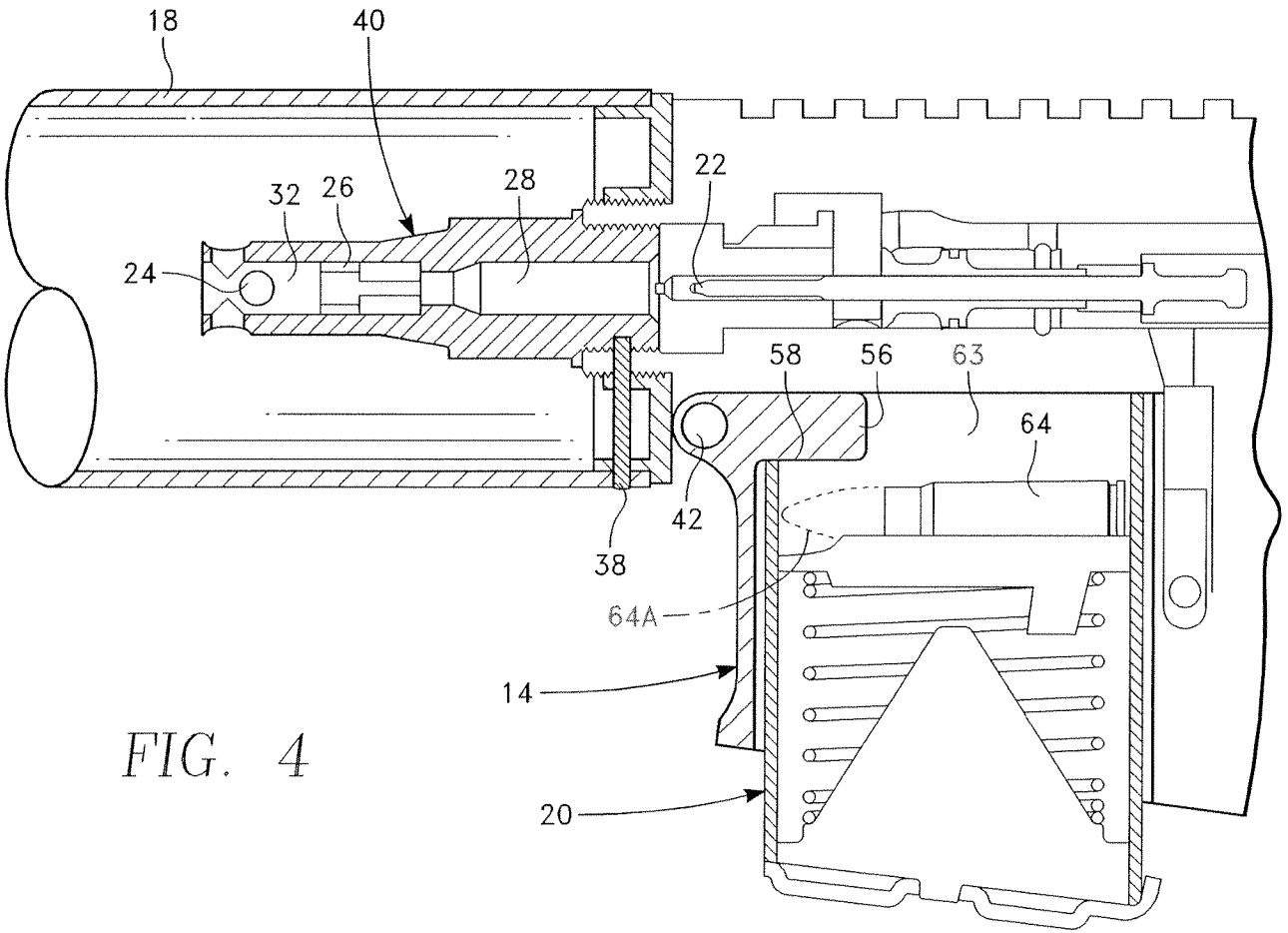
FIG. 4 is a close-up cross-sectional view of the internal portion of the flare launcher of the instant invention where the slam fire mechanism hits the gas plug.

Inside the device as seen in FIG. 3, inside the outer barrel 18 is the specialized a gas barrel/plug 32 secured to the outer barrel with a hardened pin 38 so that the device cannot be used as a firearm. The gas barrel/plug 32 includes an orifice 24 and outer tube duct that is pinned to the launcher 10 where the gas barrel would be found on the non-modified firearm with a high strength pin (not shown) so as not to be removed. It uses the orifice 24 in a gas duct to control the burn rate of blank 5.56 mm/223 caliber cartridges 28 through predictable high back pressure and a deflector gas plug in the launcher barrel to block projectiles from the orifice plug 32 yet allowing high pressure gases 34 to build up. There are slots 26 on a piece that is screwed into the inside of the outer tube (plenum) 40.

The gas 34 in turn propels flares 16, housed in the outer barrel 18 to specified distances 36. Blank cartridge gases 34 are deflected into the plenum (outer tube) tube 40 to allow gas 34 to contract to a lower pressure that is suitable for the launch and ignition of large format flares 16. The attempted use of a live round will keep the bolt carrier group 30 out of batter and will render the launcher 10 non-functional. The functionality of the launcher 10 of the instant invention is NOT like any typical rifle with the modifications listed. However, the launcher 10, in form, fit and function is similar to current and former military rifles as well as other training service agencies rifles. Therefore, it is easy to use and formalization of operation is easy.

The launcher 10 is equipped with a safety, forward access, a magazine release and BCG dust cover. The launcher 10 is painted with alert orange at the muzzle end to indicate that it is not a firearm. There is no typical trigger on the launcher 10 receiver 14. It utilizes a bolt drop lever 60 and a slam fire 22 operation. The launcher 10 cannot be converted into a firearm without major modifications.

The modified bolt carrier group 30 uses a slam fire mechanism with a slam fire pin 22 that goes inside the bolt carrier group 30. This allows the bolt carrier group 30, upon slamming the firing pin 22 and putting the blank 28 into the chamber that the flare 16 will launch as soon as it is seeded, all without a trigger device. Adjacent the butt stock 50 is a buffer tube 52 wherein is housed the buffer spring 56 which forces the actuator bolt/slam fire actuator 62 forward to allow the slam fire mechanism to operate when the actuator bolt 62 hits the firing pin 22 which fires the blank 28 initiating the gas pressure that launches the flare 16. To operate, the user 12 puts a flare 16 in the outer barrel 18, then puts in the modified magazine 20 with blank 28 and then aims the outer barrel 18 and then activates the bolt drop lever 60 to launch the flare 16. Because of the welded magazine block 56, no live round 64 can be utilized.

To summarize, the launcher of the instant invention is modified from an automatic rifle, commonly known as an AR-15 to become a flare launcher that cannot be used as a firearm. The modifications are set out herein for the manufacture of the device. The gas tube is removed from the upper receiver 14A of the non-modified rifle, disabling the bolt carrier group 30 from automatic operation. The gas port is plugged and welded closed which prevents an operational gas tube from being installed on the launcher 10. The outer tube 18 is pinned with a non-removable hardened pin 38. A single blank cartridge 28 is fed into the launcher 10 via a ten-round modified magazine 20. Manual cocking of the charging handle 44 is required between firings. The ported gas barrel/plug 32, manufactured specifically for this launcher 10, employs an external hardened end 48 with offset hole 24 with welded plug.

The offset hole 24 is offset from center by 0.130 inch. This inner barrel 32 enables acceptance of a 5.56 mm/223 cal. blank round 28 only. This plug 32 prevents any projectile from passing through the ported gas barrel and prevents the firing of live ammunition. The outer barrel 18 is pinned with a hardened pin 38. This pins the barrels 18,32 to the barrel nut housing in order to prevent removal and installation of a functional rifle barrel on the receiver 14. This outer barrel pin 38 is inserted through both the outer and inner barrels 18,32.

With only gas 34 from the blank 28 passing through the barrels 18,32, the flare 16 is launched and propelled approximately 300 feet and the flare 16 is lighted with appropriate delay to function. The welded magazine block 56 does not allow a standard magazine be used, but can only receive the specialized modified magazine 20. The modified magazine 20 includes a notch 58 that allows the magazine 20 to be fitted around the magazine block 56 that is welded in the receiver 14. Note, that only a modified magazine 20 can be used that will only allow a blank 28 to be loaded. Block 56 is welded in place to restrict the size of the shell passage 63.

A blank round 64 can pass freely through the opening 63 but a live round 64A (shown in phantom) can not pass through the opening 63. A notch or recess 58 is provided in the clip 20 to accommodate for the block notch 56. The slam fire trigger mechanism operates by depressing the drop bolt lever 60 down and not back like a traditional trigger. The launcher 10 will fire one round propelling the flare 14 down range.

The invention illustratively disclosed herein suitably may be practiced in the absence of any element which is not specifically disclosed herein.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A single-shot, non-automatic reloading launcher device comprising:

an upper receiver and a lower receiver modified to create a single unified receiver;

a welded magazine block inside of said single, unified receiver, said magazine block being configured to receive a specialized magazine, said specialized magazine allowing only the receipt of a single blank round;

an outer tube of sufficient size to house an item to be launched;

a gas plug positioned between said outer tube and said single, unified receiver where said single blank round is received;

a firing pin positioned proximate said single blank round;

a slam fire bolt actuator positioned proximate said firing pin;

a buffer tube proximate said slam fire bolt actuator that is activated by a drop bolt lever wherein said buffer tube is surrounded by an activating buffer coil that provides the pressure to strike said firing pin to ignite the launcher.

2. The single-shot non-automatic reloading launcher device as defined in claim 1 wherein said gas plug further comprises:

a mounting base;

an elongated member;

an external hardened end on said elongated member opposite said mounting base;

an orifice positioned along said elongated member to regulate gas flow;

one or more channels along the length of said elongated member to further regular gas flow.

3. A method of manufacturing a launching device from an existing firearm comprising the steps of:

acquiring an automatic rifle said rifle comprising an upper receiver, a lower receiver, an inner gas tube, an outer tube, a bolt carrier group, a barrel and a trigger;

removing said gas tube from said rifle from said upper receiver thereby disabling said bolt carrier group from automatic operation;

plugging the gas port left from the removal of said gas tube;

installing a gas plug;

replacing said barrel with an outer tube of sufficient size to house a large flare or other device to be launched;

pinning said outer tube to said gas plug with a non-removable hardened pin;

welding a magazine block to said lower receiver;

inserting a magazine modified to fit into said welded magazine block;

providing a single blank cartridge which is fed into said magazine;

welding shut said upper receiver and said lower receiver into a unified receiver;

removing said trigger mechanism; and replacing said trigger mechanism with a drop bolt lever.

4. The method of manufacturing a launching device from an existing firearm as defined in claim 3 wherein said gas plug further comprises:

a mounting base;

an elongated member;

an external hardened end on said elongated member opposite said mounting base;

an orifice positioned along said elongated member to regulate gas flow;

one or more channels along the length of said elongated member to further regular gas flow.

* * * * *